US005501713A

United States Patent [19]

Wilkins, Jr.

[11] Patent Number: 5,501,713

[45] Date of Patent: Mar. 26, 1996

[54] ENGINE FUELS

[76] Inventor: Joe S. Wilkins, Jr., 1706 E. Southmore, Pasadena, Tex. 77502

[21] Appl. No.: 238,266

[22] Filed: May 4, 1994

[51] Int. Cl.[6] ..... C10L 1/18

[52] U.S. Cl. ..... 44/307; 44/451

[58] Field of Search ..... 44/307, 308, 451

[56] References Cited

U.S. PATENT DOCUMENTS

| | | | |
|---|---|---|---|
| 31 | 9/1836 | Jennings . | |
| 1,469,148 | 9/1923 | Chevalier | 44/307 |
| 3,650,711 | 3/1972 | Unick et al. . | |
| 3,876,762 | 4/1975 | Rabussier et al. . | |
| 4,131,434 | 12/1978 | Gonzalez . | |
| 4,336,024 | 6/1982 | Denissenko et al. . | |
| 4,533,487 | 8/1985 | Jones . | |
| 4,617,025 | 10/1986 | Naiman et al. . | |
| 4,620,855 | 11/1986 | Higgins . | |
| 4,623,363 | 11/1986 | Zaweski et al. . | |
| 4,818,250 | 4/1989 | Whitworth . | |
| 4,847,182 | 7/1989 | Worns et al. . | |
| 5,061,606 | 10/1991 | Telser et al. . | |
| 5,252,107 | 10/1993 | Wilkins, Jr. | 44/307 |

FOREIGN PATENT DOCUMENTS 58-96689 6/1983 Japan .

60-106887 6/1985 Japan .

OTHER PUBLICATIONS

Higley, H. B., *All About Engines,* Ch. 6, "Fuel, Lubrication, and Cooling," pp. 25–29 (1992) month unavailable.

"Alcohol Fuels Research," Southwest Research Institute, San Antonio, Texas. date unavailable.

"Methanol Flame Luminosity," Southwest Research Institute San Antonio, Texas (Sep. 1990).

Hare, C. T. and White, J. J., "Toward the Environmentally--Friendly Small Engine; Fuel, Lubricant, and Emission Measurement Issues," Southwest Research Institute. pp. 1–31.

Grant, L. J., and Brownlow, A. D., "Qualifying Fuels to Avoid Intake Valve Deposits," Southwest Research Institute, San Antonio, Texas (Jun. 1990).

Phibro Energy (Houston, Texas) MSDS on 250–66 Solvent (i.e. VM&P Naphtha) (Dec. 30, 1991), pp. 1–8.

*Primary Examiner*—Jacqueline V. Howard
*Attorney, Agent, or Firm*—Laura G. Barrow

[57] ABSTRACT

Novel engine fuels for igniting internal combustion engines (2-cycle, 4-cycle, and diesel engines) and jet propulsion engines are disclosed. The fuels, which comprise terpenes, preferably limonene, are more efficient, and in most embodiments, environmentally safer than conventional petroleum based fuels (e.g. gasoline) and nitromethane-based fuels presently on the market.

14 Claims, No Drawings

ENGINE FUELS

BACKGROUND OF INVENTION

1. Field of Invention

The present invention is related to novel engine fuels which are more efficient and environmentally safer than conventional fossil fuels and nitromethane-based fuels. The inventive fuel compositions are suitable for igniting internal combustion engines, specifically 2-cycle, 4-cycle, and diesel engines, as well as jet propulsion engines.

2. Description of Related Art

Presently, race cars and dragsters having 4-cycle internal combustion engines use fuels containing as much as 90 to 95% nitromethane. Similarly, the smaller Hobby car and airplane 2-cycle engines use fuels containing from 10% to 40% nitromethane, over 50% methanol, and from about 18% to about 24% oil. While these fuels possess the necessary high levels of BTU's required to run these engines, nitromethane fuels are very dangerous as well as toxic to the environment. A conventional nitromethane (10%)/methanol (70%)/oil (20%) fuel, for example, has a vapor pressure of 196 mm Hg and thus, is very explosive. These fuels also leave relatively large amounts of liquid raw residue in the exhaust and are environmentally unsafe. In addition, the relatively large percentage of lubricating oil present in the fuel mixture, in particular conventional 2-cycle oils, also contributes to these emissions.

The small utility engines found in lawn and garden equipment such as lawnmowers, weedeaters, chain saws, grass blowers, and grass edgers as well as outboard motors and motorcycles, for example, are typically 2-cycle engines which generally use gasoline fuels containing a petroleum-based 2-cycle lubricating oil as a direct component of the fuel. Gasoline/oil fuels are used as an alternative to nitromethane fuels in the smaller Hobby engines, as well. From an environmental standpoint, the use of a gasoline/oil fuel in these 2-cycle engines has a more direct effect in producing emission pollutants than gasoline-only fuels used in most 4-cycle engines, primarily due to the additional oil component present in the fuel. [There are also special 4-cycle engines that, like 2-cycle engines, do not have a crankcase and thus require that a lubricating oil be directly added to the fuel.] For example, it was reported that many small utility engines produce up to 50 times the pollution of trucks per horsepower hour; that mowing the lawn for half an hour can produce as much smog as driving a new car 172 miles; and that using a chain saw for two hours gives off as many hydrocarbons as a car driven from coast-to-coast. [California Air Resources Board, statements in connection with a public hearing Dec. 14, 1990 in San Francisco, Calif., "Small Engine Emissions," *Technology Today*, p.3, March 1991.] Consequently, there is a desire to reduce the amount of emissions produced from these small engines, either by fuel reformulation or the more costly redesign of present engines.

There have been various efforts to replace conventional fossil fuels typically used in 4-cycle internal combustion engines. In U.S. Pat. No. 4,818,250 to Whitworth, for example, a purified limonene fuel is disclosed for ignition of an internal combustion engine. This patent suggests that the limonene processed according to its teachings is a suitable additive for conventional fuels or may be used by itself as an alternative to such fuels. The limonene fuel is purified to remove contaminants and as much water as possible. The fuel is further processed to prevent gum formation, either by dehydrogenation of the limonene itself to remove the double bonds or by the addition of a suitable antioxidant. Since limonene has a relatively high flash point of about 113° to 124° F., depending upon the grade used, the fuel described by Whitworth is not capable, by itself, of igniting an engine unless the engine has a high voltage ignition. Large 4-cycle engines present in automobiles and trucks, for example, have high voltage constant electronic ignitions which are sufficient to ignite a fuel having such a high flash point. Conversely, 2-cycle engines generally require fuels having much lower flashpoints.

U.S. Pat. No. 4,818,250 further discloses other alternatives to conventional fuels, including U.S. Pat. No. 4,131,434 to Gonzalez, which is directed to a fuel additive for oil, diesel oil, and gasoline to improve fuel efficiency and reduce resulting air pollutants. Exemplary Gonzalez additives are aromatic and aliphatic hydrocarbon solvents with and without oxygenated functional groups, terpenes, and aromatic nitrogen containing compounds.

U.S. Pat. No. 2,402,863 to Zuidema et al., which is also discussed in the Whitworth patent, is directed to blended gasoline of improved stability and, more particularly, leaded gasoline containing up to about 10% alicyclic olefins which preferably contain a cyclohexane ring. Cyclic olefin is defined as an alicyclic hydrocarbon containing an olefin double bond in the ring (preferably no more than one). The alicyclic olefin are suggested to be available from terpenes or from synthesis such as partial dehydrogenation of naphthenes. A number of individual cyclic olefin are stated as being suitable, including, for example, terpenes such a di-limonene (citene) and $d^{+}1$ limonene (dipentene).

It is therefore desireable to design an alternative fuel that is as efficient if not more efficient than conventional fuels, is safer, and environmentally cleaner.

SUMMARY OF THE INVENTION

The present invention is related to novel engine fuels useful for the ignition of internal combustion engines, in particular 2-cycle, 4-cycle, and diesel engines, as well as jet propulsion engines. The inventive engine fuels may be used alone as alternatives to conventional engine fuels, or as fuel additives for other conventional fuels such as petroleum-based fuels (i.e. fossil fuels) and nitromethane fuels, for example. In certain aspects of the present invention, the inventive fuel is particularly useful as a replacement for the more dangerous and environmentally hazardous nitromethane fuels used in small Hobby car and airplane 2-cycle engines and large 4-cycle engines found in race cars, for example. The inventive fuel is also a safer, more efficient, and in most embodiments, an environmentally cleaner fuel than conventional fossil fuels, such as gasoline, used to ignite small 2-cycle utility engines, such as those used in lawn and garden equipment, outboard motors, and motorcycles, for example, as well as 4-cycle engines also found in some garden equipment and in automobiles and trucks, for example. In particular, particulate emissions are especially reduced since less oil, if any, is present in the inventive fuel to burn. Certain compositions of the inventive fuel are at least 60% more efficient in terms of gallons per hour (GPH) than conventional 2-cycle and 4-cycle engine fuels, for example, and exhibit a low flash point and high BTU's.

Specifically, the inventive fuels comprise at least one terpene, preferably limonene. Limonene in particular is both a biologically and environmentally safe substance as well as an effective engine fuel. Since limonene also has sufficient lubricating qualities, certain aspects of the inventive fuel require little or no lubricating oil. Satisfactory lubricating oils which may be employed, however, include conventional petroleum-based oils, naturally occurring oils such as castor bean oil, for example, and synthetic oils containing both petroleum-based and natural oils.

Because terpenes such as limonene have relatively high flash points, the inventive fuels contain at least one component which has a lower flash point, and thus contributes to lowering the overall flash point of the entire fuel for better ignition. Suitable "flash-point" lowering compounds include alcohols, more preferably alcohols having preferably from one to six carbon atoms, and aliphatic hydrocarbon solvents such as aliphatic petroleum distillates, preferably VM&P Naphtha. Like the terpenes, these components are environmentally cleaner than conventional fossil fuels and nitromethane fuels. Alternatively, ketones such as methyl ethyl ketone may also be used, but are not as environmentally safe.

Finally, some embodiments of the inventive fuel further include the use of water and/or at least one surfactant. These fuels are especially useful for 2-cycle engines in which a coolant such as water is desirable.

DETAILED DESCRIPTION OF THE PREFERRED EMBODIMENT

The present invention is directed to fuels for igniting engines, including internal combustion engines such as 2-cycle, 4-cycle, and diesel engines as well as jet propulsion engines. [As already discussed herein, there are also special 4-cycle engines that do not have a crankcase and, like 2-cycle engines, require oil as a direct fuel component. Thus, the preferred inventive fuels suitable for 2-cycle engines are also preferred for these "special" 4-cycle engines.] The characteristics of the inventive fuels include greater efficiency in terms of gallons per hour (GPH), improved safety due to a lower vapor pressure, and cleaner burning resulting in fewer emissions and particulates being released into the atmosphere.

The term "inventive fuels" as used herein refers to those fuel compositions which may be used alone as alternatives to conventional fuels or as fuel additives to be used in combination with other conventional fuels (e.g. petroleum-based and nitromethane-based fuels) to ignite an engine. When used as a fuel additive for petroleum-based and nitromethane-based fuels, a preferred formulation is about 50 volume % conventional fuel and about 50 volume % inventive fuel.

All of the inventive fuels comprise a terpene as one of the components. Terpenes are widely distributed in nature and are present in nearly all living plants. It is generally recognized that the term "terpene" not only applies to isoprene oligomers, but also to their saturated or partially saturated isomers as well as to their derivatives, which are referred to as terpenoids, such as, for example, alcohols, aldehydes, esters, and the like. Terpenes have been widely used as flavor and perfume materials. Common monoterpenes include turpentine and limonene.

The preferred terpene is limonene which is a naturally occurring chemical found in high concentrations in citrus fruits and spices. While d-limonene is the more preferred isomer, l-limonene may also be used in the present invention (l-limonene is also found in naturally occurring substances such as pine-needle oil, oil of fir, spearmint, and peppermint, for example.) In addition to uses as flavor additives and perfume materials, limonene has been used in household and industrial cleaning products. Limonene is commercially available from Florida Chemical Company, Inc. in three different grades, namely untreated/technical grade, food grade, and lemon-lime grade. The food grade comprises about 97% d-limonene, the untreated/technical grade about 95% d-limonene, and the lemon-lime grade about 70% d-limonene, the balance in all being other terpene hydrocarbons and oxygenated compounds. The technical and food grades of limonene are the most preferred for use in this invention and require no additional purification to remove impurities or water. Further, depending upon the particular components present, the inventive fuels preferably comprise from about 10 w/w % to about 50 w/w % limonene. Since limonene possesses natural lubricating properties, at least 15 w/w % should be present if the fuel contains no lubricating oil. However, if the fuel comprises lower concentrations of limonene ranging from about 10 w/w % to about 15 w/w %, the fuel should further comprise a sufficient amount of at least one lubricating oil as well.

Limonene has a flash-point ranging from about 113° F. to about 124° F., depending on the purity of the material. Due to its high flash point, limonene alone will not easily ignite an engine unless subjected to a very high temperature spark resulting from a high voltage ignitions commonly present in large 4-cycle and diesel engines. The inventive fuels, however, should preferably have flash points ranging from about 45° F. to about 75° F. in order to ignite the engine.

A preferred flash-point lowering compound is at least one aliphatic hydrocarbon solvent, more preferably an aliphatic petroleum distillate compound, most preferably VM&P Naphtha. VM&P Naphtha has a flash point of about 50° C., emits relatively few volatile organic compounds (VOC) when burned, blends well with limonene and the other components of the fuel, and is relatively inexpensive. Other aliphatic hydrocarbon solvents may also be used, preferably those having flash points ranging from about 45° F. to about 75° F. in order to ignite the engine. The preferred concentration range of aliphatic petroleum distillates is from about 1 w/w % to about 73 w/w %, and more preferably from about 1 w/w % to about 48 w/w % when an alcohol is also present in the fuel.

Another suitable flash-point lowering compound is alcohol, preferably a lower alcohol having from one carbon atom to about six carbon atoms. At least one alcohol may be used in lieu of, or in addition to, the aliphatic petroleum distillate such as VM&P Naphtha, for example. Illustrative of suitable alcohols are methanol, ethanol, n-propanol, isopropanol, n-butyl alcohol, isobutyl alcohol, sec-butyl alcohol, n-pentyl alcohol, isopentyl alcohol, tert-pentyl alcohol, methyl amyl alcohol and the like. Methanol, ethanol, and isopropanol are the more preferred alcohols, with methanol being the most preferred of the three, primarily due to cost. The flash points of alcohols range from about 53° F. to about 103° F., depending upon which alcohol is used. Methanol, ethanol, and isopropanol, for example, have flash points of about 54°, about 53° F., and from about 53° to about 63° F., respectively, which are sufficient to ignite an engine.

Finally, at least one ketone may be used as flash point-reducing compounds in lieu of, or in addition to, the foregoing flash point lowering compounds. Suitable ketones include methyl ethyl ketone, methyl propyl ketone, methyl isobutyl ketone, methyl isoamyl ketone, methyl amyl ketone, and the like. The foregoing ketones have flash points ranging from about 24° F. to about 102° F. Methyl ethyl ketone, having a flash point of about 24° F., is the most preferred ketone. When present in the inventive fuel, ketones preferably comprise from about 37 w/w % to about 69 w/w % of the fuel. Unfortunately from an environmental standpoint, ketones are the least preferred of the suitable flash point lowering compounds mentioned herein in that these compounds are not as environmentally safe, and the resulting fuel emissions are not as clean.

The inventive fuels require comparatively little if any lubricating oil. The amount of oil present in the inventive fuels thus range from 0 w/w % to about 13 w/w %, preferably from about 3 w/w % to about 7 w/w %. Because of the reduced amounts of oil used, less particulates are released due to the burning of the oil. This is particularly true for 2-cycle engines (and "special" 4-cycle), which have no crankcases and thus require that the lubricating oil be incorporated directly into the fuel mixture. Suitable lubricating oils include conventional petroleum-based oils as well as natural oils such as Baker AA Degummed castor bean oil produced by Union Carbide, for example. Castor oil has certain advantages over petroleum-based oils. First, castor oil retains its lubricating qualities better at high temperatures than does petroleum-based oil. Second, castor oil has a higher film strength than do the petroleum-based oils, and thus will not degrade as easily. Castor oil also lubricates longer than most petroleum oils. However, in spite of these advantages, castor oil becomes very viscous at cold temperatures, and at high temperatures, castor oil tends to bake on the engine, and consequently will not easily clean off. Thus, the most preferred lubricating oil, if used, is one that employs the advantages of both castor oil and petroleum-based oils. A preferred synthetic lubricating oil is Klotz Super Synthetic with 20% Castor Oil, which comprises 80% petroleum oil and 20% castor oil.

Finally, the inventive fuel compositions may contain at least one surfactant and/or water. Water is not only an inexpensive component, but an excellent coolant. The amount of water preferably used in certain fuel compositions ranges from about 0.60 w/w % to about 9 w/w %. A sufficient amount of at least one surfactant is required when water is added and/or when methanol is used in combination with limonene in order to form a homogenous solution. The types of surfactants that can be used in the present invention are commonly known to those of skill in the art who first have the benefit of this invention's teachings and suggestions and include, but are not limited to, polyethoxyethanol non-ionic surfactants. Examples of such surfactants include, but are not limited to, Triton X-100 and Triton X-114 (octylphenoxy polyethoxy-ethanol) and Triton X-110, with Triton X-100 being the most preferred. Preferably, the amount of surfactant present in certain compositions of the present invention range from about 0.6 w/w % to about 7 w/w %, more preferably from about 0.7 w/w % to about 1.3 w/w %.

All of the inventive fuels will ignite internal combustion engines such as 2-cycle, 4-cycle, and diesel engines as well as jet propulsion engines. Smaller 2-cycle engines are those commonly found in the small Hobby race car and airplane engines, for example, which typically use nitromethane-containing fuels, gasoline, or diesel fuels. The inventive fuel compositions particularly useful in running the Hobby 2-cycle engines preferably comprise from about 20% to about 30% limonene. The inventive fuel is also useful for igniting larger 2-cycle engines present in some motorcycles and snow mobiles. Like the smaller Hobby 2-cycle engines, these engines require fuels having higher BTU's.

Larger 2-cycle engines, also known as small utility engines, are commonly found in lawn and garden equipment such as weedeaters, edgers, lawnmowers, chain saws, and grass blowers, for example. Some lawn and garden equipment employ 4-cycle engines, as well. Since these engines do not need as many BTU's to run effectively as do race car engines, including the smaller Hobby engines, less limonene may be used (limonene contains about 18,221 BTU's). Embodiments of the present inventive fuels particularly useful in running these larger 2-cycle engines preferably comprise from about 10 to about 20% limonene. However, the inventive fuels should further comprise a sufficient amount of at least one lubricating oil, preferably from about 1 w/w % to about 7 w/w %, more preferably from about 4 w/w % to about 7 w/w %, when less than about 15 w/w % of limonene is present in the fuel.

It is necessary that the engine fuel lines and "O" rings be formed of materials that are resistant to degradation by the various components present in the inventive fuels. Rubber, which is a commonly used material, is not a suitable material since it is especially susceptible to degradation by the inventive fuels. Teflon is a suitable engine line material in that it is sufficiently resistant to the inventive fuels, although other materials, such as those listed below for "O" rings, may also be used. Examples of suitable "O" ring materials which are sufficiently resistant to degradation by the inventive fuels include, but are not limited to, fluorinated ethylene propylene (Teflon FEP), polytetrafluroethylene (Teflon PTFE), perfluoroalkoxy (Teflon PFA), ethylenechlorotrifluoro-ethylene (Halar ECTFE), ethylenetetrafluoroethylene (Tetzel ETFE), polyvinylidene fluoride (PVDF), and Viton™ (a fluor elastomer). Viton™ manufactured by duPont, is the most preferred material since, like rubber, it is more flexible than Teflon.

Depending upon the type of engine and the particular vehicle/equipment, the glow plug or spark plug used must be a of a certain temperature classification. Glow plugs and spark plugs are typically classified as "cold," "mildly hot," and "hot." In order for the inventive fuels to ignite a small 2-cycle Hobby engine, the engine must have a "hot" glow plug or spark plug. 4-cycle engines present in automobiles and trucks as well as in some garden equipment require "mildly hot" to "hot" glow plugs or spark plugs. Larger 2-cycle motorcycle and outboard engines, for example, also require "mildly hot" to "hot" glow plugs or spark plugs.

As an alternative to nitromethane-containing fuels, the inventive fuels perform better than the nitromethane fuels, are more efficient (i.e. less fuel is required to run the engine), and are cleaner (i.e. the inventive fuels leave about 85% less liquid exhaust residue in the engine lines).

The following inventive fuels are some preferred formulations that work well in engines, in particular internal combustion engines. The three most preferred formulations have high BTU's and comprise VM&P Naphtha, with the most preferred fuel composition comprising, in approximately 100 ml of total fuel, from about 10 ml to about 20 ml limonene, more preferably about 20 ml (about 21 w/w %), from about 0.50 ml to about 5 ml of surfactant (preferably Triton X-100), more preferably about 1 ml (about 1.3 w/w %), from about 65 ml to about 85 ml methanol, more preferably about 75 ml (about 74 w/w %), and from about 1 ml to about 10 ml VM&P Naphtha, more preferably about 4 ml (about 3.7 w/w %). In weight/weight percent (w/w %), the preferred composition ranges are from about 10 to about 21 w/w % limonene, from about 0.7 to about 7 w/w % of surfactant (preferably Triton X-100), from about 63 to about 85 w/w % of methanol, and from about 1 to about 9 w/w % of VM&P Naphtha. The foregoing inventive fuel composition, due to the high number of BTU's, is particularly effective in motorcycle 2-cycle engines and Hobby 2-cycle engines. [If from about 10 w/w % to about 15 w/w % of limonene is present, preferably from about 1 w/w % to about 7 w/w % of at least one lubricating oil should also be present in order to ensure adequate lubricity.]

The second most preferred fuel comprises, in approximately 100 ml of total fuel, from about 10 ml to about 40 ml limonene, more preferably about 31 ml (about 31.6 w/w %), from about 0.5 ml to about 5 ml surfactant (preferably Triton X-100), more preferably about 0.5 ml (about 0.7 w/w %), from about 40 ml to about 80 ml ethanol, more preferably about 57 ml (about 55 w/w %), from about 5 ml to about 15 ml VM&P Naphtha, more preferably about 5 ml (about 4.5 w/w %) and from about 0.5 ml to about 7 ml water, more preferably 6.5 ml (about 8 w/w/%). In weight/weight percent (w/w %), the preferred composition ranges are from about 10 to about 42 w/w % limonene, from about 0.6 to about 7 w/w % surfactant (preferably Triton X-100), from about 38 to about 80 w/w % ethanol, from about 4 to about 14 w/w % VM&P Naphtha, and from about 0.6 to about 9 w/w % water. [If from about 10 w/w % to about 15 w/w % of limonene is present, preferably from about 1 w/w % to about 7 w/w % of at least one lubricating oil should also be present in order to ensure adequate lubricity.]

The third most preferred composition comprises, in approximately 100 ml of total fuel, from about 20 ml to about 40 ml limonene, from about 50 ml to about 75 ml VM&P Naphtha, and from about 1 ml to about 10 ml of at least one lubricating oil. In weight/weight percent (w/w %), the preferred composition ranges are from about 21 to about 43 w/w % limonene, from about 46 to about 73 w/w % VM&P Naphtha, and from about 1 to about 13 w/w % lubricating oil.

The next preferred composition comprises, in approximately 100 ml of total fuel, from about 20 ml to about 45 ml limonene, more preferably about 31 ml (about 32 w/w %), from about 50 ml to about 75 ml ethanol, more preferably about 63 ml (about 61 w/w %), and from about 1 ml to about 10 ml of at least one lubricating oil, more preferably about 6 ml (about 7 w/w %). In weight/weight percent (w/w %), the preferred composition ranges are from about 20 to about 46 w/w % limonene, from about 48 to about 74 w/w % ethanol, and from about 1 to about 12 w/w lubricating oil. Alternatively, from about 1 ml to about 5 ml (about 1 to about 7 w/w %) of a surfactant, more preferably about 1 ml (about 1.3 w/w %) Triton X- 100, and from about 1 ml to about 5 ml (about 1 to about 6 w/w %) of water, more preferably about 2 ml (about 2.4 w/w %), can be employed. In this latter composition, about 3 ml of lubricating oil (about 3.7 w/w % of the fuel) is more preferred.

Another preferred fuel composition comprises, in approximately 100 ml of total fuel, from about 20 ml to about 30 ml limonene, more preferably about 30 ml (about 31.5 w/w %), from about 15 ml to about 35 ml isopropanol, more preferably about 25 ml (about 25 w/w %), from about 25 ml to about 50 ml VM&P Naphtha, more preferably about 40 ml (about 37 w/w %), and from about 1 ml to about 10 ml of at least one lubricating oil, more preferably about 5 ml (about 6 w/w %). In weight/weight percent (w/w %), the preferred composition ranges are from about 21 to about 32 w/w % limonene, from about 15 to about 36 w/w % isopropanol, from about 23 to about 48 w/w % VM&P Naphtha, and from about 1 to about 13 w/w % lubricating oil.

Finally, when methyl ethyl ketone is used, a preferred formulation comprises, in approximately 100 ml of total fuel, from about 20 ml to about 40 ml limonene, more preferably about 32 ml (about 32 w/w %), from about 40 ml to about 70 ml methyl ethyl ketone, more preferably about 61 ml (about 59 w/w %), from about 0.5 ml to about 5 ml of a surfactant, more preferably about 1 ml (about 1 w/w %) Triton X-100, from about 1 ml to about 5 ml water, more preferably about 3 ml (about 3.6 w/w %), and from about 1 ml to about 10 ml of at least one lubricating oil, more preferably about 3 ml (3.6 w/w %). In weight/weight percent (w/w %), the preferred composition ranges are from about 20 to about 41 w/w % limonene, from about 37 to about 69 w/w % methyl ethyl ketone, from about 0.6 to about 6 w/w % surfactant, from about 1 to about 6 w/w % water, and from about 1 to about 12 w/w % lubricating oil.

No special equipment is required to formulate the inventive fuels, and all mixing may be performed under ambient conditions. However, depending upon which components are used in a particular fuel formulation, the order of mixing may be important. In all cases, it is preferable to add slowly the various components to the terpene. If a surfactant is to be used, it should preferably be added to the terpene with stirring until blended, i.e. approximately 2 to about 5 minutes. Next, if an alcohol or a ketone is used, it should then be added to the terpene or terpene/surfactant mixture, with stirring, until blended. If methanol is used, it should be added slowly, and the resulting solution will appear cloudy until about two-thirds of the methanol has been added, afterwhich the solution will clear. If an aliphatic petroleum distillate is used, such as VM&P Naphtha, for example, it should then be added slowly to the foregoing mixture, with stirring, until blended. Finally, the lubricating oil is added last, if desired, with stirring until blended.

If water is to be added to the fuel composition, it should be added slowly to the terpene/surfactant mixture prior to the addition of the other components. Next, other flash point lowering compounds such as methanol may be added, and if a lubricating oil is desired, it is added last.

The following examples are not intended to limit the scope of the invention, but are intended to illustrate the various aspects of the invention.

EXAMPLE 1

Comparison between Nitromethane/Methanol and Test Fuel A in a 4-Cycle Engine A study was conducted in a 4-cycle engine (manufactured by Saito) comparing one inventive fuel composition to a nitromethane fuel manufactured by OMEGA (OMEGA Competition Fuel) comprising 10% nitromethane, 75% methanol, and 15% synthetic lubricating oil. A total of 100 ml of the nitromethane fuel was added to the engine tank. Test Fuel A comprised 20 ml d-limonene (technical grade—manufactured by Florida Chemical Company, Inc.), 1 ml Triton X-100, 75 ml methanol, and 4 ml VM&P Naphtha for a total of about 100 ml and was added to the engine tank. For each test, the fuel/air mixture valve jet, which regulates the amount of fuel from the gas tank into the carburetor, was adjusted to allow fuel to ignite the engine, and the adjustment varied depending upon the fuel used. If more fuel was required to ignite the engine, the valve would be opened further to allow more fuel to enter the carburetor. One method of quantitatively measuring relatively how much the valve was opened was to count the number of "clicks" heard by the operator as the valve was turned. The larger the number of clicks (i.e. more turns) heard as the valve was turned, the greater the valve opening, thus allowing more fuel to enter the carburetor.

The number of revolutions per minute (RPM) was preset manually at 5,500 using a Royal Drive Tachometer. For each test, the engine was allowed to run for 25 minutes. Upon completion of the test, the following results were recorded for each fuel:

Test Fuel A

Engine temperature: 59.5° F.

Response: 8–9 (a score of 10 is perfect)

Liquid fuel residue remaining from exhaust: 1 ml

Volume of fuel remaining in tank after 25 minutes: 50 ml

Fuel adjustment (i.e. fuel/air mixture valve jet): About one 90° turn (about 10 "clicks")

10% Nitromethane/75% Methanol Fuel

Engine temperature: 68° F.

Response: 8–9 (a score of 10 is perfect)

Liquid fuel residue remaining from exhaust: 12 ml

Volume of fuel remaining in tank: 3 ml

Fuel adjustment (i.e. fuel/air mixture valve jet): About one and one-half 180° turns (about 33 "clicks")

Test Fuel A in this experiment ran cooler, which reduces wear on the engine. In addition, less fuel was required to run the engine for 25 minutes, as evidenced by the fuel remaining in the tank upon completion of the run. Almost all of the nitromethane fuel was consumed after only about 7 minutes. Furthermore, Test Fuel A produced less liquid residue in the exhaust, demonstrating a smaller amount of particulates released into the atmosphere.

EXAMPLE 2

Comparison between Nitromethane/Methanol and Test Fuel A in a 2-Cycle Engine The two fuels compared in Example 1 for a 4-cycle engine were compared again in a Mangum 40GP 2-cycle engine.

For each test, 100 ml of fuel was added to the engine tank. The fuel/air mixture valve jet was adjusted to allow the fuel to ignite the engine, and the adjustment varied depending upon the fuel used, as described in Example 1.

The number of revolutions per minute (RPM) was preset manually at 5,500 using a Royal Drive Tachometer. For each test, the engine was allowed to run for 25 minutes. Upon completion of the test, the following results were recorded for each fuel:

Test Fuel A

Engine temperature: 62° F.

Response: 9–10

Liquid fuel residue remaining from exhaust: 0.5 ml

Volume of fuel remaining in tank after 25 minutes: 50 ml

Fuel adjustment (i.e. fuel/air mixture valve jet): About one 90° turn (about 10 "clicks")

10% Nitromethane/75% Methanol Fuel

Engine temperature: 70° F.

Response: 9–10

Liquid fuel residue remaining from exhaust: 21 ml

Volume of fuel remaining in tank: 1 ml

Fuel adjustment (i.e. fuel/air mixture valve jet): About one and one-half 180° turns (about 33 "clicks")

As in the 4-cycle engine comparison study described in Example 1, similar results were obtained. In particular, Test Fuel A ran cooler, significantly less fuel was consumed during the 25-minute run, as well as significantly less liquid fuel was remaining from the exhaust.

EXAMPLE 3

A test was conducted to compare the inventive fuel with gasoline/oil in a 125-cc Yamaha motorcycle 2-cycle engine.

The following fuel compositions were compared:

Fuel A 200 ml of gasoline (Exxon 93 octane)/Klotz Super Synthetic with 20% Castor Oil (20:1 gasoline/oil)

Fuel B 100 ml of gasoline (Exxon 93 octane)/Klotz Super Synthetic with 20% Castor Oil (20:1 gasoline/oil)

20 ml d-limonene, 1 ml Triton X-100, 75 ml methanol, and 4 ml VM&P Naphtha

Fuel C 40 ml d-limonene, 2 ml Triton X-100, 150 ml methanol, 6 ml VM&P Naphtha, and 2 ml Klotz Super Synthetic with 20% Castor Oil Fuel D 56 ml d-limonene, 2 ml Triton X-100, 136 ml methanol, and 8 ml VM&P Naphtha Upon completion of the test, the following results were recorded for each fuel:

Fuel A

Starting temperature: 85° F.

Fuel adjustment (i.e. fuel/air mixture valve jet): 4½ 180° turns

Exhaust smoke: 5 (5 is a subjective value indicating the normal standard for conventional engine fuels, with a value of 0 indicating no smoke exhaust)

Fuel B

Starting temperature: 79° F.

Fuel adjustment (i.e. fuel/air mixture valve jet): 2¼ 180° turns

Exhaust smoke: 0

Fuel C

Starting temperature: 79° F.

Fuel adjustment (i.e. fuel/air mixture valve jet): ⅛ 180° turn

Exhaust smoke: 0

Fuel D

Fuel adjustment (i.e. fuel/air mixture valve jet): ⅛ 180° turn

Exhaust smoke: 0

EXAMPLE 4

The following fuel compositions (approximately 100 ml each) were tested in a 2-cycle Hobby airplane engine (O.S. Engine FSR/ABC Type 0.45 cc):

Fuel A: 10% nitromethane/methanol and 2-cycle oil

Fuel B: 20% nitromethane/methanol and 2-cycle oil

Fuel C: 20 ml d-limonene/1 ml Triton X-100/75 ml methanol/4 ml VM&P Naphtha

Fuel D: 20 ml d-limonene/1 ml Triton X-114/70 ml ethanol/5 ml VM&P Naphtha/1.5 ml water/2.5 ml Klotz Super Synthetic with 20% Castor Oil The results of the test are shown in Table 1.

TABLE 1

| | Max. RPM | Exhaust temp. (F.°) | Head temp. (F.°) | Fuel/Air setting[1] |
|---|---|---|---|---|
| A | 11,500 | 100 | 70 | 1.5 turns |
| B | 12,000 | 101 | 71[2] | 1.5 turns |
| C | 13,800 | 79 | 71 | ⅛ turn |

TABLE 1-continued

| | Max. RPM | Exhaust temp. (F.°) | Head temp. (F.°) | Fuel/Air setting[1] |
|---|---|---|---|---|
| D | 13,500 | 81 (76[2]) | 78 (76[2]) | ⅜ turn[3]<br>¼ turn[4] |

[1]One complete turn = 360°.
[2]At 5,500 rpm
[3]At 2,000 rpm
[4]At 1,000 rpm

I claim:

1. A fuel for igniting an engine comprising:

at least one terpene;

at least one alcohol having from about one to about six carbon atoms; and at least one lubricating oil;

such that the combination of said at least one terpene, said at least one alcohol, and said at least one lubricating oil act as an engine fuel for igniting an engine.

2. The fuel of claim 1, wherein said terpene is limonene.

3. The fuel of claim 2, wherein said engine is a 2-cycle engine.

4. The fuel of claim 2, wherein said engine is a 4-cycle engine.

5. The fuel of claim 2, wherein said at least one alcohol is selected from the group consisting of methanol, ethanol, propanol, and isopropanol.

6. The fuel of claim 5, wherein said terpene comprises from about 10 w/w % to about 50 w/w % of said fuel and said alcohol comprises from about 15 w/w % to about 85 w/w % of said fuel.

7. The fuel of claim 1, wherein said at least one lubricating oil comprises from about 1 w/w % to about 13 w/w % of said fuel.

8. A fuel for igniting an engine comprising:

limonene;

at least one alcohol having from about one to about six carbon atoms; and at least one lubricating oil;

such that the combination of said limonene, said at least one alcohol, and said at least one lubricating oil act as an engine fuel for igniting an engine.

9. The fuel of claim 8, wherein said alcohol is selected from the group consisting of methanol, ethanol, propanol, and isopropanol.

10. The fuel of claim 9, wherein said limonene comprises from about from about 10 w/w % to about 50 w/w % of said fuel and said alcohol comprises from about 15 w/w % to about 85 w/w % of said fuel.

11. The fuel of claim 8, wherein said at least one lubricating oil comprises from about 1 w/w % to about 13 w/w % of said fuel.

12. The fuel of claim 11, wherein said fuel comprises about 20 w/w % to about 46 w/w % limonene, from about 48 w/w % to about 74 w/w % of at least one alcohol, and from about 1 w/w % to about 13 w/w % of at least one lubricating oil.

13. The fuel of claim 12, wherein said limonene comprises about 32 w/w % of said fuel, said at least one alcohol is ethanol and comprises about 61 w/w % of said fuel, and said at least one lubricating oil comprises about 7 w/w % of said fuel.

14. The fuel of claim 12, wherein said fuel further comprises about 2.4 w/w % water and about 1.3 w/w % of at least one surfactant, and wherein said limonene comprises about 32 w/w % of said fuel, said at least one alcohol is ethanol and comprises about 61 w/w % of said fuel, and said at least one lubricating oil comprises about 3.7 w/w % of said fuel.

* * * * *

UNITED STATES PATENT AND TRADEMARK OFFICE

CERTIFICATE OF CORRECTION

PATENT NO. : 5,501,713
DATED : March 26, 1996
INVENTOR(S) : Joe S. Wilkins, Jr.

It is certified that error appears in the above-indentified patent and that said Letters Patent is hereby corrected as shown below:

Column 11:

In claim 3, line 1, delete "2" and insert -- 1 --.

In claim 4, line 1, delete "2" and insert -- 1 --.

In claim 5, line 1, delete "2" and insert -- 1 --.

Signed and Sealed this

Twentieth Day of August, 1996

Bruce Lehman

*Attest:*

BRUCE LEHMAN

*Attesting Officer*

*Commissioner of Patents and Trademarks*